US005380588A

United States Patent [19]

Nishiyama et al.

[11] Patent Number: 5,380,588

[45] Date of Patent: Jan. 10, 1995

[54] POLYVINYL ALCOHOL-BASED SYNTHETIC FIBER

[75] Inventors: Masakazu Nishiyama; Yasuhiro Harada; Akio Mizobe, all of Okayama, Japan

[73] Assignee: Kuraray Company Limited, Kurashiki, Japan

[21] Appl. No.: 902,866

[22] Filed: Jun. 23, 1992

[30] Foreign Application Priority Data

Jun. 24, 1991 [JP] Japan ..... 3-180262
Jan. 20, 1992 [JP] Japan ..... 4-030111
Jan. 20, 1992 [JP] Japan ..... 4-030112

[51] Int. Cl.[6] ..... D02G 3/00

[52] U.S. Cl. ..... 428/364; 525/60; 525/61

[58] Field of Search ..... 525/60, 61; 428/364

[56] References Cited

U.S. PATENT DOCUMENTS 3,080,207 3/1963 Tanabe et al. .
3,741,724 6/1973 Harmon .
3,850,901 11/1974 Tanaka et al. ..... 525/56

FOREIGN PATENT DOCUMENTS 0150513 8/1985 European Pat. Off. .
0286112 10/1988 European Pat. Off. .
13857 4/1972 Japan ..... 525/56
63-120107 5/1988 Japan .
3120107 5/1988 Japan .
1104815 4/1989 Japan .
2127568 5/1990 Japan .
2133605 5/1990 Japan .
2249705 5/1990 Japan .
2210072 8/1990 Japan .

OTHER PUBLICATIONS

WPIL, File Supplier, Derwent Publications Ltd., London, GB; AN-91-327862 & JP-A-3 213 510 (Unikita KK) 18, Sep. 1991.

*Primary Examiner*—Judy M. Reddick
*Attorney, Agent, or Firm*—Oblon, Spivak, McClelland, Maier & Neustadt

[57] ABSTRACT

Provided are polyvinyl alcohol-based synthetic fiber having excellent performances as a fiber for FRC that is prepared by autoclave curing and its very effective production processes. One of the processes comprises having a monoaldehyde or a dialdehyde or its acetalization product penetrate into the central region of a polyvinyl alcohol-based synthetic fiber at a first stage and then, at a second stage, effecting crosslinking reaction with a mixed solution containing a monoaldehyde and an acid. The other process comprises conducting acetalization with a bath containing 100 to 250 g/l of formaldehyde and 30 to 80 g/l of sulfuric acid at a temperature of 70° to 100° C. The processes can give a polyvinyl alcohol-based synthetic fiber having a strength of at least 11 g/d, a gel elasticity of at least $6.0\times10^{-3}$ g/cm·d and a dissolution ratio of not more than 40% and being able to withstand an autoclave curing at 140° C. which is necessary for securing the dimensional stability of the resulting cement products.

3 Claims, No Drawings

POLYVINYL ALCOHOL-BASED SYNTHETIC FIBER

BACKGROUND OF THE INVENTION

1. Field of the Invention

The present invention relates to a polyvinyl alcohol (hereinafter referred to as "PVA")-based synthetic fiber useful for industrial materials for which hot water resistance is required, in particular for fiber-reinforced cement (hereinafter referred to as "FRC") which is subjected to autoclave curing, and a process for its production.

The present invention also relates to an FRC reinforced with the above PVA-based synthetic fiber and having excellent dimensional stability, in particular excellent toughness under wet conditions.

2. Description of the Prior Art

Health injury caused by asbestos has become apparent in recent years, and its use is becoming more and more legally restricted. PVA-based synthetic fiber has highest strength and modulus among general-purpose fibers and also high adhesiveness with cement and resistance to alkali. Demand for the fiber as a replacement of asbestos in the field of FRC is therefore rapidly growing.

PVA-based synthetic fiber is, however, inherently poor in wet heat resistance and dissolves at a wet temperature of at least about 130° C., whereby its autoclave curing is impossible and only room-temperature curing has been used. Although carbon fiber is used as an asbestos replacement in some uses at present, carbon fiber has poor adhesiveness with cement matrix and thus produces only poor reinforcement effect. Moreover, carbon fiber is far more expensive than asbestos or PVA-based synthetic fiber.

Attempts have been made to improve the wet heat resistance of PVA-based synthetic fiber. For example, Japanese Patent Application Laid-open No. 133605/1990 discloses a process which comprises blending an acrylic polymer, or crosslinking the fiber surface with an organic peroxide, isocyanate, blocked isocyanate, urethane-based compound, epoxy-based compound or the like.

However, blending of an acrylic polymer may not be successful, since the acrylic polymer blended will dissolves out during solvent extraction process in the spinning of the blend. Even if part of undissolved acrylic polymer crosslinks, the crosslinkage that is formed by ester bond readily hydrolyzes with the alkali of cement, thus being unable to withstand autoclave curing.

Besides, crosslinking of only fiber surface results, during autoclave curing, in swelling and dissolution from inside of the fiber, whereby satisfactory wet heat resistance cannot be obtained.

The concept of surface crosslinking is to restrict the regions crosslinked to only the fiber surface, because crosslinked structure inside the fiber will hinder high-draft drawing of the fiber so that high-strength fiber becomes difficult to obtain. However, since the PVA fiber obtained under this concept is crosslinked preferentially on its surface, the fiber swells or dissolves from its inside when contacted with hot water, as described above.

This phenomenon is more marked when the fiber is used for FRC. That is, reinforcement fiber for FRC is generally mixed into cement in the form of short cut fibers, the cut surfaces of which are directly exposed to vapor and cement components containing alkali. Then, central part of the cross-sections which is not crosslinked swells or dissolves. Accordingly, crosslinking of fiber surface only cannot improve the wet heat resistance applicable to FRC. The present inventors have actually confirmed that, with the crosslinked fiber of this type, reinforcement effect diminishes during autoclave curing at 140° C.

Japanese Patent Application Laid-open No. 249705/1990 discloses a process for improving the fatigue resistance of a PVA fiber used for tire cords, which comprises crosslinking the fiber. To achieve the crosslinking, the disclosure includes, in addition to a process which comprises treating a PVA fiber cord with a crosslinking agent, a process which comprises adding a crosslinking agent to a spinning dope solution or a coagulating bath so that the agent can penetrate into the inside of the fiber and crosslinks there. However, if a crosslinking agent is added to a spinning dope solution, it will dissolve out into the coagulating bath used. If a crosslinking agent is added to a coagulating bath, it cannot penetrate into and crosslink the inside of the resulting fiber, since the coagulating bath does not diffuse there but simply acts to remove the solvent used from the extruded streams of the spinning dope solution used. In both cases, the improvement of the wet heat resistance, which is an object of the present invention, is not achieved.

Japanese Patent Application Laid-open No. 120107/1988 discloses a process which comprises formalizing to a degree of formalization of 5 to 15 mol% a PVA-based synthetic fiber having been drawn in a drawing ratio of at least 15. This level of formalization, however, renders hydrophobic only very small part of the amorphous region of the fiber so that the finished fiber cannot withstand autoclave curing. As described in detail later herein, such a fiber has a gel elasticity as defined in the present invention of $1\text{-}2\times10^{-3}$ g/cm·d at most and is thus clearly distinguished from the fiber of the present invention.

By the way, autoclave curing as so far discussed is conducted to secure a good dimensional stability of cement products. During the curing, calcium oxide and silica react to form a crystal called tobermolite. This reaction proceeds under a wet heat condition of at least 140° C. preferably at least 160° C. which can relatively shorten the curing time.

While the temperature desired for practical curing thus at least 160° C., it has been impossible, as described above, with conventional techniques to produce a PVA-based synthetic fiber that can withstand such a severe curing condition stably.

Autoclave curing generally improves dimensional stability but decreases bending strength and strain, i.e. toughness of bending, especially under wet conditions. Reinforcing fibers to be autoclave-cured are therefore required to exhibit the effect of improving the bending toughness. A toughness ratio under wet condition of at least 1.2 is desirable for practical purposes.

Although carbon fiber is, as described above, in some cases used as an asbestos replacement that can withstand such hard treatment as autoclave curing, the fiber can hardly improve bending toughness due to its low elongation. This is another reason, i.e. besides its very high price as compared with asbestos or PVA-based synthetic fiber, why carbon fiber has not been widely used.

Japanese Patent Application Laid-open No. 213510/1991 discloses an autoclave-curable PVA-based synthetic fiber having a "hot water resistance" of at least 140° C. The specification mentions in its Example one having a hot water resistance at 158° C. The hot water resistance as referred to in that specification is, however, the temperature of water in which a fiber is dissolvable. The fiber disclosed therefore cannot withstand the autoclave curing discussed herein.

SUMMARY OF THE INVENTION

Accordingly, an object of the present invention is to provide a PVA-based synthetic fiber having highly improved hot water resistance that can withstand autoclave curing at at least 140° C., preferably at least 160° C., which it has been impossible to produce by conventional techniques.

Another object of the present invention is to provide an inexpensive autoclave-cured hydraulic shaped article having excellent dimensional stability and bending toughness.

As a result of intensive studies to solve the problems, the present inventors have found a close correlation between resistance to autoclaving and the gel elasticity that represents the degree of crosslinking, and completed the invention.

Thus, the fiber of the present invention is a PVA-based synthetic fiber having a strength of at least 11 g/d, a gel elasticity of at least $6.0\times10^{-3}$ g/cm·d and a dissolution ratio of not more than 40%.

A fiber should have a strength of at least 11 g/d to produce satisfactory reinforcement effect. Further to withstand autoclave curing at 140° C., the fiber should have a gel elasticity of at least $6.0\times10^{-3}$ g/cm·d and a dissolution ratio of not more than 40%. To withstand a preferable autoclave curing temperature of 160° C., the gel elasticity is preferably at least $8.0\times10^{-3}$ g/cm·d.

The present invention further provides a process for producing the above fiber which comprises applying, to a PVA-based synthetic fiber having a strength of at least 13 g/d, an aqueous solution or emulsion containing a monoaldehyde, a dialdehyde or its acetalization product, or both, and then, at a second stage, acetalizing the fiber by treating with a mixed solution of a monoaldehyde and an acid.

The present invention still further provides a process for producing the above fiber which comprises acetalizing a PVA-based synthetic fiber having a strength of at least 13 g/d with a bath containing 100 to 250 g/l of formaldehyde and 30 to 80 g/l of sulfuric acid at a temperature of 70° to 100° C.

An autoclaved FRC article having a dimensional stability of not more than 0.75% and a toughness ratio under wet condition of at least 1.2 is obtained by incorporating 0.3 to 10% by weight of the PVA-based synthetic fiber of the present invention into a hydraulic molding material, molding the resulting mixture and then autoclave-curing the mixture at a temperature of at least 140° C.

Accordingly, the present invention realizes a hydraulic shaped article having excellent dimensional stability that has been achieved only with asbestos causing health hazard or with expensive carbon black, as well as excellent bending toughness. The present invention is therefore of great significance.

DETAILED DESCRIPTION OF THE PREFERRED EMBODIMENTS

For the purpose of providing a PVA-based synthetic fiber with wet heat resistance, it is necessary to introduce crosslinkage between the PVA molecules. The gel elasticity as defined in the invention numerically expresses the degree of the crosslinkage and larger gel elasticity means higher degree of crosslinkage. The method for the determination of gel elasticity is, while being described in more detail later herein, roughly as follows. Aqueous zinc chloride solutions are strong solvent for PVA and can readily dissolve PVA-based synthetic fibers. If, however, PVA molecules of a PVA-based fiber are crosslinked, an aqueous zinc chloride solution dissolves PVA crystals but does not dissolve the entire fiber due to the presence of crosslinked network. In this case the fiber becomes, while shrinking, gel-like. The gel thus formed exhibits a stress-strain behavior that follows Hook's law. The gel elasticity as defined herein corresponds, so to speak, the spring constant.

The dissolution ratio as defined in the invention is, also to be later-described in more detail, the reduction in weight of a fiber when its 6-mm cut chips are immersed in an artificial cement solution at 160° C. and indicates how uniformly the crosslinking has been introduced in the radial direction of the cross-section of the fiber. A dissolution ratio of more than 40% cannot produce reinforcement effect upon autoclave curing at at least 140° C.

The dissolution ratio of a fiber, however, varies depending on its cut length, since dissolution of fibers generally proceeds starting at their cut ends. In the present invention, the dissolution ratio is determined on 6-mm samples. For example a dissolution ratio of 40% on 6-mm sample corresponds to that of about 50% on a 3-mm sample of the same fiber.

Although the above-mentioned gel elasticity represents the degree of crosslinking in a fiber, it does not always reflect the uniformity of crosslinking in the fiber. In the present invention, while the gel elasticity constitutes, so to speak, the necessary condition to withstand autoclave curing at 140° C., the above dissolution ratio condition is the sufficient condition. It is therefore necessary to satisfy both conditions.

The present inventors have tested various PVA-based fibers having a different gel elasticity and found that a fiber having a larger gel elasticity is less damaged by autoclave curing. Thus, a gel elasticity of at least $6.0\times10^{-3}$ g/cm·d is necessary for enabling the fiber to be autoclave-cured. It has also been found that a dissolution ratio of not more than 40% assures sufficient wet heat resistance. The gel elasticity and the dissolution ratio are more preferably at least $8.0\times10^{-3}$ g/cm·d and not more than 30%, respectively.

With known crosslinking processes, the above necessary gel elasticity level is achieved only under conditions of extremely high agent concentration and high heat drawing and treatment temperatures. Such severe conditions however significantly decreases the fiber strength, whereby it has been difficult to obtain a fiber having a strength of at least 11 g/d necessary for fibers for FRC. It has also been difficult to make the crosslinking agent used penetrate into the central part of the treated fiber, and a dissolution ratio of not more than 40% therefore has not been achieved.

Although there are no particular restrictions to the process for producing the fiber of the present invention, there exist markedly effective processes, which comprise acetalyzing a PVA-based synthetic fiber having a strength of at least 13 g/d under specific conditions. The present invention proposes two processes therefor.

One comprises applying to the fiber at a first stage an aqueous solution or emulsion containing a monoaldehyde, a dialdehyde or its acetalization product, or both, and then treating, at a second stage, the fiber with a mixed solution of a monoaldehyde and an acid. The aqueous emulsion is prepared with a suitable emulsifier when the aldehyde used is hydrophobic.

The other comprises acetalizing with a bath containing 100 to 250 g/l of formaldehyde and 30 to 80 g/l of sulfuric acid at a temperature of 70° to 100° C.

The above 2-stage process is first explained below.

In the first stage, a monoaldedyde, a dialdehyde or its acetalization product, or both is permitted to penetrate into the central part of a PVA-based fiber without crosslinking the molecules of the fiber. In the second stage, the fiber is then treated with a mixed solution of a monoaldehyde and an acid to effect inter-molecular crosslinking reaction between PVA and the aldehyde applied in the first stage and, at the same time, to form intramolecular crosslinkages in PVA.

Accordingly, this process of the present invention is characterized by separation of a procedure for penetrating a monoaldehyde, a dialdehyde or its acetalization product or both, into the central part of a fiber (first stage) and one for effecting crosslinking reaction by action of a catalyst acid (second stage).

If an aldehyde and an acid are simultaneously applied to a PVA-based synthetic fiber, crosslinking will start at the fiber surface. The crosslinked surface is very firm and dense and markedly inhibits penetration of the crosslinking agent into the central part. Besides, where a dialdehyde or its acetalization product is used, they are very unstable in the presence of an acid and their function as crosslinking agents for PVA tends to be deactivated, which is a fatal drawback of the direct system.

The 2-stage process of the present invention can solve all these problems and is desirable from the viewpoint of both fiber properties and productivity.

For the first stage, where an aldehyde is, as described above, permitted to penetrate into the central region of fiber, a monoaldehyde, a dialdehyde or its acetalization product, or both can be used.

Monoaldehydes generally have a swelling function for PVA-based fibers and readily penetrate into the central region of the fibers. Then, the monoaldehydes form crosslinkage in the central region. Known monoaldehydes are usable for this purpose, such as formaldehyde, acetaldehyde and benzaldehyde, among which formaldehyde is most suitable in view of penetration property and minimization of decrease in the fiber strength. Application conditions, i.e. concentration and temperature, are suitably adjusted to avoid excess swelling and generally selected are 5 to 100 g/l, preferably 20 to 70 g/l for the concentration and 50° to 95° C., preferably 70° to 90° C. for the temperature.

Dialdehydes or their acetalization products are also usable at the first stage and effective for increasing gel elasticity. In this case, however, care must be taken because their use tends to decrease the fiber strength. The concentration is generally 0.3 to 25 g/l and preferably 0.5 to 15 g/l, more preferably 1.0 to 10 g/l. Examples of the dialdehyde usable in the present invention are linear compounds, such as glyoxal, malondialdehyde, succinaldehyde, glutaraldehyde and hexane-1,6-dial, and aromatic compounds, such as orthophthalaldehyde, isophthalaldehyde, terephthalaidehyde and phenylmalondialdehyde. These dialdehydes may be used alone or in combination of 2 or more. Preferred among these dialdehydes in view of penetratability into fiber and reactivity are glutaraldehyde, malondialdehyde, succinaldehyde and acetalization products of the foregoing, and particularly preferred is glutaraldehyde.

Among these dialdehydes, those that have high reactivity and polymerize in the absence of an acid, like malondialdehyde, may, after being acetalized with an alcohol, be used as acetalization products for crosslinking PVA. Typically, tetramethoxypropane, obtained by acetalization of malondialdehyde with methanol, is stable in the absence of an acid, but returns to the dialdehyde by reaction with an acid and becomes reactable with PVA.

Where these dialdehydes or their acetalization products are used, an auxiliary agent capable of promoting their penetration into the central region of fiber can be used. Any auxiliary agent may be used for this purpose as long as it can swell PVA-based fiber, but desirable are those monoaldehyde that can react with PVA by themselves, in particular formaldehyde. Where a monoaldehyde and a dialdehyde or its acetalization product are used in combination, their concentrations are selected to be nearly the same as that when each of them is used singly.

Since this first stage is, as described above, to permit the aldehyde used to penetrate into the central region of fiber, the aldehyde should not undergo acetalization reaction with the PVA. It is necessary for this purpose that the aldehyde-containing solution used in the first stage contain substantially no acid or like acetalization catalysts.

Then follows treatment with a mixed solution of a monoaldehyde and an acid. The monoaldehyde is used here to prevent the aldehyde having penetrated into the central region of the fiber in the first stage from diffusing into the second stage bath by reverse osmosis, as well as to increase the degree of acetalization as later described.

Known monoaldehydes such as formaldehyde and benzaldehyde are usable in the second stage, among which formaldehyde is most preferred.

The concentration is 10 to 150 g/l and preferably 30 to 20 g/l, more preferably 50 to 100 g/l. Any acid can be used as a reaction catalyst and, where, typically, sulfuric acid is used, its concentration is 10 to 200 g/l and preferably 30 to 150 g/l.

The bath temperature is suitably adjusted in view of the intended reaction rate and the swelling of the fiber and generally about 60° to 95° C., preferably 70° to 90° C. Sodium sulfate may be added to the bath to suppress the swelling degree.

It is recommended that the degree of acetalization after the above treatments be at least 15 mol %, preferably 20 to 35 mol %.

The fiber of the present invention can also be obtained by, besides the above 2-stage process, a process which comprises treating a PVA-based synthetic fiber having at least 13 g/d with a bath containing 100 to 250 g/l of formaldehyde and 30 to 80 g/l of sulfuric acid and at a temperature of 70° to 100° C.

Formalization of ordinary PVA-based synthetic fibers is generally conducted in a bath containing 20 to 50 g/l of formaldehyde and 200 to 270 g/l of sulfuric acid. Thus, the process of the present invention can be said to use conditions of markedly high formaldehyde and low sulfuric acid concentrations.

Formaldehyde under ordinary conditions hardly produces intermolecular crosslinking between PVA molecules, which is reflected by gel elasticity. Employment of such a high formaldehyde and low sulfuric acid condition, however, realizes intermolecular crosslinking sufficiently into the central region of the fiber treated.

The processes of the present invention are applicable to PVA-based synthetic fibers having a strength of at least 13 g/d. Any spinning process can be employed to obtain such fibers, insofar as it assures their required strength. Thus, there can be employed known processes, for example, (1) one which comprises using a spinning dope comprising an aqueous PVA solution containing boric acid or its salt and extruding the spinning dope into an alkaline coagulating bath at a relatively high temperature and (2) one which comprises using a spinning dope comprising a solution of PVA in an organic solvent such as dimethyl sulfoxide or glycerine and extruding the spinning dope into a methanol coagulating bath. Further it is desirable to (3) add to a spinning dope one or at least two surfactant in an amount of 1 to 20% by weight based on the weight of PVA, which promotes penetration of the crosslinking agent or aldehyde used and increases the drawability of the resulting as-spun fiber. Nonionic surfactants are desirable for this purpose.

The degree of polymerization of the PVA used is not specifically restricted, but it is the higher the better to produce the desired reinforcement effect. The gel elasticity is also somewhat influenced by the degree of polymerization. Thus, the degree of polymerization is generally at least 1,500 and preferably at least 2,000, more preferably at least 3,000. The degree of saponification of the PVA is generally at least 98 mol % and preferably at least 99.5 mol %, the higher being more advantageous.

Where, in particular, 2-stage treatment is employed without using dialdehyde, high gel elasticity is rather difficult to obtain. In this case it is preferred to use a PVA-based synthetic fiber obtained from a PVA having a degree of polymerization of at least 2,000 and by adding a nonioic surfactant to the spinning dope used.

In the processes of the present invention, i.e. the above-described 2-stage process or the process comprising treating with a high-formaldehyde and low-sulfuric-acid bath, it is possible to use, in combination, other crosslinking agents. For example, crosslinking is conducted at first with an organic compound such as a methylol-based compound or a melamine-based compound, or an inorganic compound, e.g. an acid such as phosphoric acid and sulfuric acid, and their salts, and then the resulting fiber is subjected to the above acetalization treatments. It is however necessary to adjust the degree of crosslinking with such other crosslinking agents below limits not to prohibit, in the succeeding acetalization process, penetration of the aldehyde used into the central region of the fiber.

The FRC and its preparation are described next.

The above-described PVA-based synthetic fiber of the present invention having excellent reinforcement effect can be used in any form depending on the preparation process or engineering method of the desired shaped article. For example there may be used short cut fiber or chopped strands, or multifilament yarns or bundled multifilament yarns may be used in the form of endless yarn or what is known as fiber rods. Nonwoven fabrics, mat-shaped articles, meshes and 2- or 3-dimensional woven fabrics can also be used. It is also possible to use, in combination with the PVA-based synthetic fiber, other reinforcing materials such as carbon fiber and steel bar.

Where the PVA-based synthetic fiber is used as short cut fiber, it is necessary that the fiber be, while being uniformly dispersed, distributed in the matrix used. For this purpose the short cut fiber preferably has an aspect ratio (i.e. the ratio of fiber length to average diameter) of 150 to 1,500, more preferably 300 to 800.

The FRC of the present invention can be produced by any known process and no special modification thereto is necessary. For example, thin plates are prepared by wet process such as Hatschek's process, and vibration forming, centrifugal forming, extrusion and the like are available for mortars and concretes.

Cement is the representative hydraulic material used in the invention. Portland cement and other various cement species are usable and gypsum, gypsum slug, magnesia and the like can be used, singly or in combination. It is desirable, for the purpose of obtaining by autoclave curing tobermolite crystal having excellent dimensional stability as a matrix, to use a lime material such as cement, calcium hydrated lime or quick lime being mixed with a silica material such as silica sand or diatomaceous earth.

The silica to be mixed preferably has a Blaine specific surface are of at least 2,000 $cm^2/g$, more preferably at least 4,000 $cm^2/g$, most preferably at least 6,000 $cm^2/g$. Those with higher Blaine value more readily produce tobermolite crystal, have higher matrix strength and produce higher reinforcement effect when reinforced with the fiber of the present invention. These hydraulic materials can also be used, while mixed with sand or gravel, as mortar or concrete.

Auxiliaries such as mica, sepiolite, atabaljite and perlite may also be used.

The hydraulic shaped article of the present invention contains the PVA-based synthetic fiber in an amount of 0.3 to 10% by weight, preferably 0.5 to 5% by weight, more preferably 1.0 to 3.0% by weight. A content smaller than this range produces poor reinforcement effect, while larger contents result in poor dispersibility, whereby sufficient reinforcement effect becomes difficult to obtain.

Where pulp is used as an auxiliary material, its incorporation is preferably not more than 3% by weight to achieve ready forming and maintenance of noncombustibility of the shaped articles obtained.

In autoclave curing, it is necessary that the lime material and silica material used undergo hydrothermal reaction to form tobermolite crystal. For this purpose the temperature is adjusted at at least 140° C., preferably at least 150° C., more preferably at least 160° C. Higher temperature leads to higher reaction rate and shorter reaction time, which is preferred.

The hydraulic shaped articles thus obtained of the present invention, having a dimensional stability of not more than 0.15% and a toughness ratio under wet condition of at least 1.2, which are both excellent, can be used as cement or concrete shaped articles, e.g. slates, pipes, blocks, wall panels, floor panels, roofings and partition walls, and various secondary products.

Naturally, besides the above hydraulic shaped articles, the PVA-based synthetic fiber of the present invention is applicable to many end-uses. These uses include reinforcement of rubber materials, e.g. tire cords and reinforcement of hoses, agricultural and fishery materials, e.g. fishing nets and cheesecloths, reinforcement for FRP's and general-purpose industrial materials such as rope.

Other features of the invention will become apparent in the descriptions of the following exemplary embodiments which are given for illustration of the invention and are not intended to be limiting thereof. In the Examples that follow, "%" means "% by weight" unless otherwise specified. In the Examples, the strength, gel elasticity, degree of acetalization and dissolution ratio of fibers, the bending strength of slates and the dimensional stability and toughness ratio under wet condition of hydraulic shaped articles are those measured according to the following methods.

(1) Strength of fiber

Tested according to JIS L1015 with an Instron tensile tester. Short fibers with which a gauge length of 20 mm cannot be taken are measured with that of 1 mm.

(2) Gel elasticity

Fiber specimens are bundled to a total fineness of 1,000 to 2,000 deniers (multifilament yarns having a fineness within this range are used as they are). The specimen bundle is hanged down with its top end fixed and loaded at the bottom end with a weight of 1 g. The entire body is immersed in a 50% by weight aqueous zinc chloride solution at 50° C., whereby the specimen shrinks. When no further shrinkage becomes observed, the specimen length (A cm) is measured. Separately, another same specimen bundle is hanged and immersed in the same manner but with a weight of 30 g, and measured for the length (B cm) after shrinkage. The weights having a specific weight of 8 are used. A and B are read to the nearest 0.1 mm.

$$\text{Gel elasticity} = 29/(B-A)\cdot D(\text{g/cm}\cdot d)$$

where D represents the fineness in deniers of the specimen before immersion in the zinc chloride solution.

For samples cut to several millimeters the test is done as follows. At first fix the top end of a single fiber and apply a weight of C mg at the bottom end such that the gauge length becomes 2 mm. Shrink the thus prepared specimen in the same manner as above and read the length, L, cm. Prepare another specimen in the same manner with a weight of E mg (C<E) and read the length, $L_2$ cm, after shrinkage.

$$\text{Gel elasticity} = (E-C)/10^5(L_2-L_1)\cdot D(\text{g/cm}\cdot d)$$

(3) Degree of acetalization

Measured according to JIS K6729 "METHOD OF ANALYSIS OF VINYL FORMAL".

(4) Dissolution ratio

A fiber sample is cut to 6 mm. About 0.5 g (A g) is weighed and placed with 100 cc of an artificial cement solution in a stainless steel autoclave having a wall thickness of 4.5 mm. The autoclave is then immersed in an oil bath at 160° C. for 2 hours. The autoclave is taken out and cooled. The fiber is taken out, bone-dried and weighed (B g).

$$\text{Dissolution ratio} = (A-B)/A \times 100(\%)$$

The artificial cement solution herein has the composition of 3.5 g/l of potassium hydroxide, 0.9 g/l of sodium hydroxide and 0.4 g/l of calcium hydroxide.

(5) Bending strength of slate

A PVA-based synthetic fiber sample is cut to 6 mm. A mixture containing 2 parts of the short cut fiber, 3 parts of pulp and 95 parts of Portland cement is wet formed into a plate with a Hatschek machine, which is subjected to primary curing at 50° C. for 24 hours and then to autoclave curing at 160° C. for 10 hours, to give a slate. The slate obtained is tested for bending strength according to JIS K6911. Samples giving slates having a bending strength of at least 240 kg/cm$^2$ are judged to have reinforcement function.

(6) Dimensional stability of hydraulic shaped article

Measured according to JIS A5418 "TEST FOR LENGTH CHANGE UPON WATER ABSORPTION".

(7) Toughness ratio under wet condition

A slate specimen is immersed in water for 3 days. The wet specimen thus obtained is tested for bending strength with a gauge length of 5 cm and a bending stress-strain curve is prepared. In the curve, the highest point that the start-up linear line reaches is named point-A, and a point where vertical line passing A crosses the abscissa is named point-C. A point having a bending stress corresponding to 1/5 the maximum bending stress and a deflection on the high-strain side of the curve is named point-B. A point where vertical line passing B crosses the abscissa is named point D. Then, $$\text{Toughness ratio} = \text{area of } \Delta OBD/[\text{area enclosed by the linear lines } OA, OD \text{ and } BD \text{ and the curve } AB]$$

Although toughness ratio measured under dry condition is also applicable, that under wet condition, giving larger value, is employed in the present invention.

EXAMPLES

Example 1

A completely saponified PVA having a degree of polymerization of 1,800 was dissolved in water to a concentration of 15%/PVA. To the solution, 1.5%/PVA of boric acid and 3.0%/PVA of nonylphenol-ethylene oxide 40 moles adduct were added, to obtain a spinning dope.

The spinning dope thus prepared was extruded into a coagulating bath containing 15 g/l of sodium hydroxide and 350 g/l of sodium sulfate at 60° C. and coagulated therein. The as-spun fiber thus obtained was subjected to the known successive steps of roller drawing, neutralization, wet heat drawing and washing. The fiber was then immersed in a 3 g/l phosphoric acid solution, dried and dry heat drawn at 230° C. to a total drawing ratio of 23.

The fiber thus obtained had a strength of 15.3 g/d, a gel elasticity of $0.5\times10^{-3}$ g/cm·d and a dissolution ratio of 93%.

The fiber was then wound into a hank. The hank was immersed in an aqueous solution containing 2 g/l of glutaraldehyde and 50 g/l of formaldehyde, squeezed appropriately and treated with a bath containing 100 g/l of formaldehyde, 70 g/l of sulfuric acid and 30 g/l of sodium sulfate at 80° C.

The properties of the fiber thus obtained and the properties of the slate reinforced with the fiber are shown in Table 1.

Comparative Example 1

Example 1 was repeated except that the dry heat drawing was conducted to a total drawing ratio of 13, to obtain a drawn fiber having a strength of 11.2 g/d. The fiber thus obtained was 2-stage treated in the same manner as in Example 1.

The properties of the fiber thus obtained and the properties of the slate reinforced with the fiber are shown in Table 1.

Comparative Example 2

Example 1 was repeated except that the 2-stage treatment was replaced by a 1-stage treatment with a bath containing 2 g/l of glutaraldehyde, 100 g/l of formaldehyde, 70 g/l of sulfuric acid and 30 g/l of sodium sulfate at 80° C.

The properties of the fiber thus obtained and the properties of the slate reinforced with the fiber are shown in Table 1.

TABLE 1

| | Example 1 | Comp. Ex. 1 | Comp. Ex. 2 |
|---|---|---|---|
| Strength (g/d) | 12.5 | 9.7 | 11.3 |
| Gel elasticity ($\times 10^{-1}$ g/cm · d) | 9.8 | 9.6 | 10.5 |
| Degree of acetalization (mo %) | 18.9 | 21.2 | 14.8 |
| Dissolution ratio | 26 | 28 | 48 |
| Bending strength of slate (kg/cm$^2$) | 260 | 190 | 180 |

As is apparent from Table 1, the fiber having the desired properties can only be obtained by the process of the present invention.

In Comparative Example 1, the obtained fiber had a low strength, having satisfactory wet heat resistance though.

In Comparative Example 2, crosslinking had not been introduced into the central region of fiber due to 1-stage treatment. As a result the obtained fiber had a large dissolution ratio and wet heat degradation started in its central region and progressed outwardly during autoclave curing.

Examples 2 and 3 and Comparative Examples 3 and 4

A completely saponified PVA having a degree of polymerization of 3,000 was dissolved in dimethyl sulfoxide to a concentration of 12%. The solution thus obtained was extruded into a methanol bath via an air clearance by dry-jet-wet spinning. The extruded stream was extracted, wet drawn and dried in the known manner and then dry heat drawn at 235° C. to a total drawing ratio of 21. The obtained drawn fiber had a strength of 19.1 g/d. The fiber was subjected to crosslinking treatment with various conditions. The treating conditions and the properties of the treated fibers, and the properties of the slates reinforced with the fibers are shown in Table 2.

TABLE 2

| | Example 2 | Example 3 | Comp. Ex. 3 | Comp. Ex. 4 |
|---|---|---|---|---|
| First stage | | | | |
| Glutaraldehyde (g/l) | 0.8 | — | — | — |
| Formaldehyde (g/l) | 70 | — | — | — |
| Temperature (°C.) | 85 | — | — | — |
| Second stage | | | | |
| Formaldehyde (g/l) | 70 | 150 | 50 | 100 |
| Sulfuric acid (g/l) | 100 | 50 | 200 | 200 |
| Sodium sulfate (g/l) | 50 | 50 | 100 | 50 |
| Temperature (°C.) | 70 | 80 | 80 | 80 |
| Properties | | | | |
| Strength (g/d) | 16.1 | 15.0 | 16.0 | 15.3 |
| Gel elasticity ($\times 10^{-3}$ g/cm · d) | 11.2 | 13.2 | 2.3 | 5.2 |
| Degree of acetalnation (mol %) | 21.9 | 19.4 | 19.6 | 20.1 |
| Dissolution ratio (%) | 16 | 20 | 62 | 35 |
| Bending strength of slate (kg/cm$^2$) | 320 | 290 | 170 | 190 |

Example 4

A completely saponified PVA having a degree of polymerization of 3,500 was dissolved in water in a concentration of 11%. To the solution, boric acid and nonyl phenol-ethylene oxide 40 moles adduct were added in amounts of 1.8%/PVA and 7%/PVA, respectively, to obtain a spinning dope.

The spinning dope thus prepared was spun in the same manner as in Example 1. The as-spun fiber was, in the usual manner, roller-drawn, neutralized, wet heat drawn, washed and dried, successively. The fiber was then drawn at 235° C. to a total drawing ratio of 27, to give a drawn fiber having a strength of 20 g/d.

The drawn fiber thus obtained was then 2-stage treated with a first bath containing 50 g/l of formaldehyde at 80° C. and a second bath containing 100 g/l of formaldehyde, 70 g/l of sulfuric acid and 100 g/l of sodium sulfate at 85° C.

The fiber thus treated showed a strength of 18.1 g/d, a gel elasticity of $13.8\times 10^{-1}$ g/cm·d, a degree of acetalization of 18.1 mol %, a dissolution ratio of 13% and a bending strength of slate of 350 kg/cm$^2$, which was excellent.

Example 5

The fiber obtained in Example 1 was cut to a length of 6 mm. A mixture containing 2% by weight of the short cut fiber, 3% by weight of pulp, 55% by weight of Portland cement and 40% by weight of silica powder having a Braine value of 5,400 cm$^2$/g was wet formed into a plate with a Hatschek machine, which was then autoclave-cured at 160° C. for 10 hours, to give a slate having a thickness of 4 mm.

The slate thus obtained had a dimensional stability of 0.10% and a toughness ratio under wet condition of 2.8, both of which were excellent.

Comparative Examples 5 and 6

The fiber obtained in Comparative Example 1 was used to obtain a slate in the same manner as in Example 5 (Comparative Example 5). The fiber before acetalization of Example 1 was 1-stage treated with a bath containing 100 g/l of formaldehyde, 200 g/l of sulfuric acid and 50 g/l of sodium sulfate at 80° C., to give an acetalized fiber having a strength of 14.8 g/d, a gel elasticity of of $5.2\times 10^{-3}$ g/cm·d, a degree of acetalization of 20.1 mol % and a dissolution ratio of 35%. The fiber was used to obtain a slate in the same manner as in Example 5 (Comparative Example 6). The slates thus obtained had very poor properties as shown in Table 3.

TABLE 3

| | Comparative Example 5 | Comparative Example 6 |
|---|---|---|
| Dimensional stability (%) | 0.11 | 0.12 |
| Toughness ratio under wet condition | 1.1 | 1.0 |

Examples 6 and 7 and Comparative Examples 7 and 8

A completely saponified PVA having a degree of polymerization of 3,000 was dissolved in dimethyl sulfoxide in a concentration of 12%. The solution thus obtained was extruded into a methanol bath via an air clearance by dry-jet-wet spinning. The extruded stream was extracted, wet drawn and dried in the known manner and then dry heat drawn at 235° C. to a total drawing ratio of 21. The obtained drawn fiber had a strength of 19.1 g/d. The fiber was acetalized in the same manner as in Example 5, to give a fiber having a strength of 17.7 g/d, a gel elasticity of $10.2\times10^{-3}$ g/cm·d, a degree of acetalization of 19.1 mol % and a dissolution ratio of 22%.

The fiber thus obtained was cut to a length of 6 mm. Slates were prepared in the same manner as in Example 5 with the short cut fiber being added in an amount of 0.1% by weight (Comparative Example 7), 0.5% by weight (Example 6), 5.0% by weight (Example 7) and 11% by weight (Comparative Example 8). The dispersibility of the fiber and the properties of each of the slates are shown in Table 4.

TABLE 4

| | Comparative Example 7 | Example 6 | Example 7 | Comparative Example 8 |
|---|---|---|---|---|
| Dispersibility | good | good | good | poor |
| Dimensional stability (%) | 0.08 | 0.11 | 0.11 | 0.15 |
| Toughness ratio under wet condition | 1.0 | 1.3 | 3.9 | 1.1 |

In Comparative Example 7, the fiber could not produce reinforcement effect because of too low an addition. In Comparative Example 8, too high an addition caused poor dispersibility so that satisfactory slate properties could not obtained.

Examples 8 and 9 and Comparative Example 9

Example 5 was repeated except that autoclave curing condition were changed. The conditions employed and the results obtained are shown in Table 5.

TABLE 5

| | Example 8 | Example 9 | Comp. Ex. 9 |
|---|---|---|---|
| Autoclave temperature (°C.) | 145 | 170 | 135 |

TABLE 5-continued

| | Example 8 | Example 9 | Comp. Ex. 9 |
|---|---|---|---|
| time (hours) | 15 | 8 | 20 |
| Dimensional stability (%) stability (%) | 0.12 | 0.08 | 0.20 |
| Toughness ratio under wet condition | 3.8 | 2.7 | 3.7 |

As is apparent from the table sufficient dimensional stability cannot be obtained at low autoclaving temperatures even when the curing time is prolonged.

Example 10

A completely saponified PVA having a degree of polymerization of 4,000 was dissolved in water in a concentration of 10%. To the solution, 2.0%/PVA of boric acid and 6.0%/PVA of nonylphenol-ethylene oxide 40 moles adduct were added, to obtain a spinning dope.

The spinning dope thus prepared was spun in the same manner as in Example 1 and the as-spun fiber was subjected to the known successive steps of roller drawing, neutralization, wet heat drawing, washing and drying. The fiber was then dry heat drawn at 240° C. to a total drawing ratio of 27, to give a drawn fiber having a fineness of 2 deniers and a strength of 20.5 g/d.

The fiber was 2-stage treated with the following baths.

First stage: formaldehyde 60 g/l 75° C.

Second stage: formaldehyde 100 g/l sulfuric acid 80 g/l sodium sulfate 50 g/l 80° C.

The fiber thus treated had a strength of 18.3 g/d, a gel elasticity of $13.9\times10^{-3}$ g/cm·d, a degree of acetalization of 24.5 mol % and a dissolution ratio of 12%.

The fiber was cut to a length of 6 mm and a slate was wet-formed in the same manner as in Example 5, which was then autoclave-cured at 170° C. for 10 hours.

The slate thus obtained had a dimensional stability of 0.07% and a toughness ratio under wet condition of 3.7, both of which were excellent.

Obviously, numerous modifications and variations of the present invention are possible in light of the above teachings. It is therefore to be understood that within the scope of the appended claims, the invention may be practiced otherwise than as specifically described herein.

What is claimed is:

1. A acetalized polyvinyl alcohol-based synthetic fiber having a tensile strength of at least 11 g/d, a gel elasticity of at least $6.0\times10^{-3}$ g/cm·d and a dissolution ratio of not more than 40%.

2. A polyvinyl alcohol-based synthetic fiber according to claim 1, wherein said gel elasticity is at least $8.0\times10^{-3}$ g/cm·d.

3. A polyvinyl alcohol-based synthetic fiber according to claim 1, wherein said fiber contains intermolecular crosslinking.

* * * * *